US010004375B2

(12) United States Patent
Heidel et al.

(10) Patent No.: US 10,004,375 B2
(45) Date of Patent: Jun. 26, 2018

(54) METHOD FOR OPERATING A WATER-CONDUCTING DOMESTIC APPLIANCE

(75) Inventors: Andreas Heidel, Holzheim (DE); Reinhard Hering, Holzheim (DE); Bernd Kränzle, Finningen (DE)

(73) Assignee: BSH Hausgeräte GmbH, Munich (DE)

( * ) Notice: Subject to any disclaimer, the term of this patent is extended or adjusted under 35 U.S.C. 154(b) by 1169 days.

(21) Appl. No.: 13/879,812

(22) PCT Filed: Oct. 21, 2011

(86) PCT No.: PCT/EP2011/068474

§ 371 (c)(1),
(2), (4) Date: Apr. 17, 2013

(87) PCT Pub. No.: WO2012/059349

PCT Pub. Date: May 10, 2012

(65) Prior Publication Data

US 2013/0220374 A1 Aug. 29, 2013

(30) Foreign Application Priority Data

Nov. 3, 2010 (DE) ..... 10 2010 043 328

(51) Int. Cl.
*A47L 15/00* (2006.01)
*A47L 15/42* (2006.01)

(52) U.S. Cl.
CPC ..... *A47L 15/0018* (2013.01); *A47L 15/0023* (2013.01); *A47L 15/0049* (2013.01);
(Continued)

(58) Field of Classification Search
None
See application file for complete search history.

(56) References Cited

U.S. PATENT DOCUMENTS

2006/0219262 A1* 10/2006 Peterson et al. ..... 134/18
2008/0149144 A1 6/2008 Siebachmeyer
(Continued)

FOREIGN PATENT DOCUMENTS

EP 1277431 A1 1/2003
EP 1967121 * 9/2008 ..... A47L 15/0023
(Continued)

OTHER PUBLICATIONS

Machine English Translation for EP1277431.*
(Continued)

*Primary Examiner* — Mikhail Kornakov
*Assistant Examiner* — Pradhuman Parihar
(74) *Attorney, Agent, or Firm* — Michael E. Tschupp; Andre Pallapies; Brandon G. Braun

(57) ABSTRACT

A method for operating a water-conducting domestic appliance, such as a dishwasher, includes filling the water-conducting domestic appliance with a minimum amount of filling water that is circulated by a pump, and checking a water flow diverter for malfunctions and determining from an operational parameter of an electromotor that drives the pump whether the pump runs smoothly, thereby indicating whether the quantity of filling water corresponds to at least a nominal quantity of filling water. When the water flow diverter is not malfunctioning, the pump is again checked for smooth running or a refilling step is carried out to increase the minimum amount of filling water. Conversely, when the water flow diverter is malfunctioning, the check for smooth running or the refilling step are omitted.

20 Claims, 2 Drawing Sheets

(52) U.S. Cl.
CPC ..... *A47L 15/4221* (2013.01); *A47L 15/4244* (2013.01); *A47L 2401/07* (2013.01); *A47L 2401/08* (2013.01); *A47L 2401/30* (2013.01); *A47L 2501/01* (2013.01); *A47L 2501/03* (2013.01)

(56) References Cited

U.S. PATENT DOCUMENTS

| | | | |
|---|---|---|---|
| 2010/0121497 | A1 | 5/2010 | Heisele et al. |
| 2011/0048459 | A1 | 3/2011 | Hesterberg et al. |
| 2011/0126863 | A1 | 6/2011 | Kränzle et al. |

FOREIGN PATENT DOCUMENTS

| | | | | | |
|---|---|---|---|---|---|
| EP | 1277431 | | * | 12/2008 | ..... A47L 15/0049 |
| EP | 1967121 | B1 | | 7/2011 | |
| WO | WO2008125482 | | * | 10/2008 | ..... A47L 15/0049 |
| WO | 2010052040 | A2 | | 5/2010 | |

OTHER PUBLICATIONS

Machine English Translation for EP1967121.*
Machine English Translation for WO2008125482.*
International Search Report PCT/EP2011/068474 dated Apr. 17, 2012.

* cited by examiner

METHOD FOR OPERATING A WATER-CONDUCTING DOMESTIC APPLIANCE

BACKGROUND OF THE INVENTION

The invention relates to a method for operating a water-conducting domestic appliance, in particular a dishwasher, having a circulating pump and a water flow diverter that is associated with the circulating pump, in particular arranged downstream of the circulating pump, and has at least one control element that can be adjusted by a control element motor in order to change the direction of flow of a liquid through the water flow diverter, wherein the water-conducting domestic appliance is filled with a minimum quantity of filling water that can be circulated by the circulating pump and in a first step the water flow diverter is checked for malfunctions and in a second step it is checked by means of a true running test whether the size of the minimum quantity of filling water in the water-conducting domestic appliance corresponds at least to the size of a setpoint quantity of filling water required to ensure the true running of the circulating pump, wherein to check true running, at least one operational parameter of an electric motor driving the circulating pump is evaluated to ascertain whether it corresponds to true running of the circulating pump.

Water-conducting domestic appliances are supplied by way of a corresponding connector with water, to which detergents or rinse agents and optionally further agents are added in the domestic appliance and which is conveyed into a work chamber, in which items to be washed, for example dishes (dishwasher) or items of clothing (washing machine) are present. To keep water consumption low, the liquid introduced into the work chamber is collected during the wash operation and then conveyed back into the work chamber. Circulating pumps are provided for this purpose. With known domestic appliances a water flow diverter is associated with the circulating pump, being connected downstream in the flow direction in particular and serving to set flows of liquid or direct them in a desired direction. When used in a washing machine, water flow diverters serve for example to direct wash or rinse water for example into a first or second wash chamber of two wash chambers. When used in dishwashers, water flow diverters serve for example to conduct flows of wash water, also referred to as wash liquor, for example to a spray arm for an upper rack and/or to a spray arm for a lower rack. To this end the water flow diverters have at least one control element that can be moved by motor, by means of which different throughflow openings of the water flow diverter can be opened and/or closed by the control element in response to corresponding activation signals, to set the desired distribution of the flows of liquid. Water-conducting domestic appliances such as dishwashers run through wash programs in this process, said wash programs comprising a number of wash program steps, which each start with the dishwasher being filled with a minimum quantity of wash water and end with a pumping operation to convey the now dirty quantity of wash water out of the dishwasher. If the circulated quantity of wash water is smaller than the quantity required for reliable operation, for example because wash water collects in a glass or pot that is facing upward and can no longer be circulated, the result can be an unpleasant noise due to the pump taking in air or the cleaning and drying result may not be satisfactory.

BRIEF SUMMARY OF THE INVENTION

The object of the invention is therefore to remedy this.

According to the invention provision is made for a true running check or a refilling step for increasing the minimum quantity of filling water to be performed when there is no malfunction of the water flow diverter and for the true running check or refilling step to be omitted if a malfunction of the flow diverter is ascertained. If the water flow diverter is malfunctioning, it can mean for example that the true running check can falsely produce the result that the circulating pump is running dry for example, which can then be followed by a refilling operation to increase the quantity of liquid circulated with the result that the water-conducting domestic appliance is overfilled and water exits from the water-conducting domestic appliance. Only when it is ascertained that the water flow diverter is functioning correctly does a true running check take place with the aim of ascertaining whether at least the setpoint quantity of filling water can be circulated in the water-conducting domestic appliance. To perform the true running check here as an operational parameter for example the power consumption of the motor driving the circulating pump can be monitored for fluctuations produced by the intake of air by the circulating pump when the fill level is too low. However if the water flow diverter function check shows that it is not functioning correctly, no true running check takes place. A refilling step can also be omitted, with which the quantity of filling water can be increased when the water flow diverter is functioning, so that overfilling with water exiting from the water-conducting domestic appliance is prevented. The domestic appliance can be filled with a minimum quantity of filling water before, after or even during the first step to check the function of the water flow diverter or before the second step, in which a true running check is performed.

Provision is preferably made here, to check whether there is a malfunction, for activation signals for activating the control element motor and sensor signals from at least one sensor for detecting the position of the control element of the water flow diverter to be evaluated. With the position detection sensor it is possible to move the control element of the water flow diverter to a defined position at the start of a wash program or during individual steps by activating the control element motor, as the control element may not be in a defined position, for example due to a power failure. It can thus be concluded that the water flow diverter is functioning, when a sensor signal is detected within a certain time period in response to activation of the control element motor.

In contrast it is preferably concluded that the water flow diverter is malfunctioning, when contrary to the activation signals the sensor signals correspond to a stationary control element or a control element that is in interruption-free permanent motion or the sensor signals deviate from an expected sensor signal profile or sensor signal sequence. It is thus possible on the one hand to detect for example a defect of the control element motor, which causes the control element to stop. Interruption-free permanent motion of the control element in contrast can be for example the result of a defective sensor, which means that no defined stop position is detected for the control element. Finally deviations from an expected sensor signal profile or sequence can have their cause in defective signal lines from the sensor or a malfunction of the sensor itself.

In one preferred development provision is made for the control element motor to be stopped when permanent motion of the control element of the water flow diverter is detected. Deactivating or switching off the water flow diverter ensures that the liquid can continue to be circulated, if only with a distribution defined by the now stationary control element. It is thus possible to continue a wash program for example.

In a further preferred development provision is made for the minimum quantity of filling water to be maintained when the true running check is omitted. Because when the true running check is omitted, no conclusion can be drawn about the dry running of the circulating pump, the minimum quantity of filling water is preferably maintained when the ongoing operating program of the domestic appliance has reached a point at which it can be assumed that sufficient liquid has already been supplied.

Provision is also preferably made, when the true running check is omitted, for a minimum setpoint quantity of filling water or a maximum setpoint quantity of filling water to be set. It is particularly preferable, when the true running check is omitted, for a minimum setpoint quantity of filling water to be set. The minimum setpoint quantity of filling water advantageously results from known values which ensure that the circulating pump runs wet or prevent it running dry at normal load or with a normal/average quantity of items to be washed. As an alternative to the minimum setpoint quantity of filling water, when the true running check is omitted, a maximum setpoint quantity of filling water can be set. The maximum setpoint quantity of filling water ensures on the one hand that the circulating pump runs wet and on the other hand ensures a sufficient quantity of filling water for cleaning all the items to be washed, in particular even when the domestic machine is running at maximum load. It can be determined whether the minimum setpoint quantity of filling water or the maximum setpoint quantity of filling water is set for example as a function of the wash program selected by the user.

Finally provision is preferably made for the motion of the control element of the water flow diverter to be monitored contactlessly. The motion can thus be detected for example by means of optical sensors or electromagnetic sensors. It is also conceivable to determine the power consumption of an actuator displacing/moving the control element. It is of course also conceivable to detect the motion of the control element in a manner that involves contact. Contactless detection has the advantage that there is no friction to affect the output of the actuator.

The invention also includes a water-conducting domestic appliance, in particular a dishwasher, having a circulating pump and a water flow diverter that is associated with the circulating pump, in particular arranged downstream of the circulating pump, and has at least one control element that can be adjusted by a control element motor in order to change the direction of flow of a liquid through the water flow diverter, which can be filled with a minimum quantity of filling water that can be circulated by the circulating pump, wherein means are provided to check the water flow diverter for malfunctions and to perform a true running check, wherein during the true running check the means check whether the size of the minimum quantity of filling water in the water-conducting domestic appliance corresponds at least to the size of a setpoint quantity of filling water required to ensure the true running of the circulating pump and during the true running check the means evaluate at least one operational parameter of an electric motor driving the circulating pump to ascertain whether it corresponds to true running of the circulating pump. According to the invention a true running check or refilling step can be performed to increase the minimum filling quantity when there is no malfunction of the water flow diverter and the true running check or refilling step is omitted when the facility ascertains a malfunction of the water flow diverter.

Advantageous developments are set out in the subclaims.

BRIEF DESCRIPTION OF THE DRAWINGS

The invention is described in more detail below with reference to the drawing, in which.

DETAILED DESCRIPTION OF EXEMPLARY EMBODIMENTS OF THE PRESENT INVENTION

Figure 1:
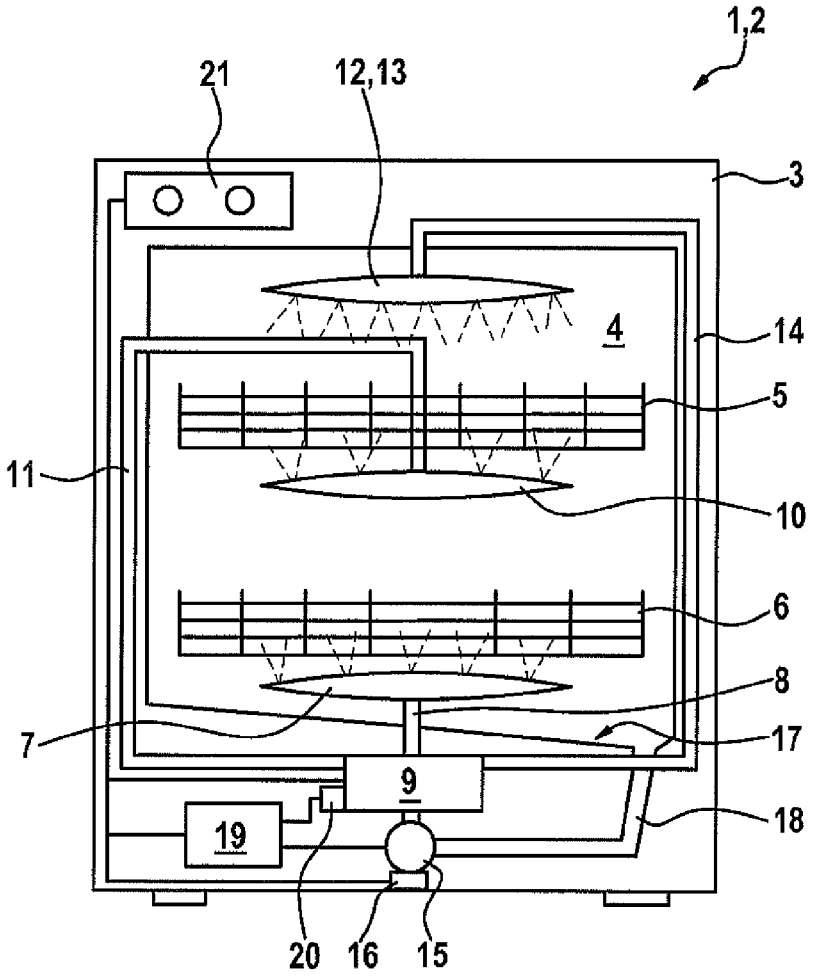
FIG. 1 shows a schematic diagram of a water-conducting domestic appliance and FIG. 2 shows a method sequence for operating the water-conducting domestic appliance.

FIG. 1 shows a simplified diagram of a water-conducting domestic appliance 1, configured in the present exemplary embodiment as a dishwasher 2. To this end the water-conducting domestic appliance 1 has a housing 3, in which a work chamber 4 is configured. Provided in the work chamber 4 are two racks 5, 6, which are configured to hold items to be washed or dishes. The rack 5 here is arranged above the rack 6. It is of course possible to provide fewer or more racks. Arranged below the lower rack 6 is a spray arm 7, which—as shown by spray jets—allows wash liquor, e.g. water, which can contain detergents or rinse aid, to be emitted from its upper face to the lower rack 6 and the items to be washed that are present therein. During the emission of said wash liquor the lower spray arm 7 rotates in the known manner due to the water pressure of the wash liquor emitted by it. The spray arm 7 is connected for fluid engineering purposes by way of a line 8 to a water flow diverter 9, which will be examined in more detail below. Arranged above the rack 6 is an upper wash arm 10 which, like the lower wash arm 8, allows wash liquor to be emitted from its upper face to the upper rack 5 and the items to be washed that are present therein. The upper wash arm 10 also rotates due to the water pressure of the wash liquor emitted by it. The wash arm 10 is also connected for fluid engineering purposes by way of a line 11 to the water flow diverter 9. Finally a so-called top spray 4 is optionally arranged above the rack 5, preferably being formed by a rotatable spray arm 13, which allows wash liquor to be emitted from its lower face in the direction of the upper rack 5 and therefore also onto the items to be washed that are present in the rack 5. The top spray 12 is connected for fluid engineering purposes by way of a line 14 to the water flow diverter 9.

The water flow diverter 9 has different connectors for the lines 11 and 14 and a connector for the pressure side of a circulating pump 15. An electric motor 16 for driving the circulating pump 15 is associated with the circulating pump 15. In its base region the work chamber 4 has a collecting apparatus 17 for liquid present in the work region, being essentially configured as a slope to conduct liquids to a line 18, which is connected to the suction side of the circulating pump 15. The liquid collected by means of the collecting apparatus in the work chamber 4 or in the wet region is supplied by way of the line 18 to the circulating pump 15, which in turn conveys the liquid to the downstream water flow diverter 9.

The water flow diverter 9 comprises at least one control element (not shown in detail here), which can be moved into different positions by a control element motor (not shown here), so that wash water or wash liquor can be emitted to the abovementioned lines 8, 11 and 14 in a manner defined in each instance. The water flow diverter 9 has a control element in the form of a rotating disk provided with through-flow openings. Water flow diverters 9 with rotating disks are generally known so the exact embodiment of the water flow diverter 9 will not be examined in detail here. Associated with the water flow diverter 9 is an actuator, in particular an electric motor-type actuator, which serves to move or rotate the rotating disk.

Finally the domestic appliance 1 has means for performing a true running check with the circulating pump 15 and for monitoring function, in other words for monitoring the motion of the control element of the water flow diverter 9 with the water flow diverter 9, which is connected to the water flow diverter for this purpose. In the present exemplary embodiment these means are combined in a facility 19 but they can be configured as two separate units. To check true running the facility 19 uses a suitable sensor or circuit to detect the actual motor current of the electric motor 16 driving the circulating pump 15 as an operational parameter. In normal operation the facility 19 sets the output of the circulating pump 15 (or the driving electric motor) and/or the quantity of filling water for the work chamber 4 of the domestic appliance 1 so that sufficient liquid, e.g. water, is available for the true running of the circulating pump 15. A contactless sensor 20 is associated with the control element of the water flow diverter 9 and connected to the facility 19, so that the facility 19 detects the motion of the control element of the water flow diverter 9 by means of the sensor 20.

Figure 2:
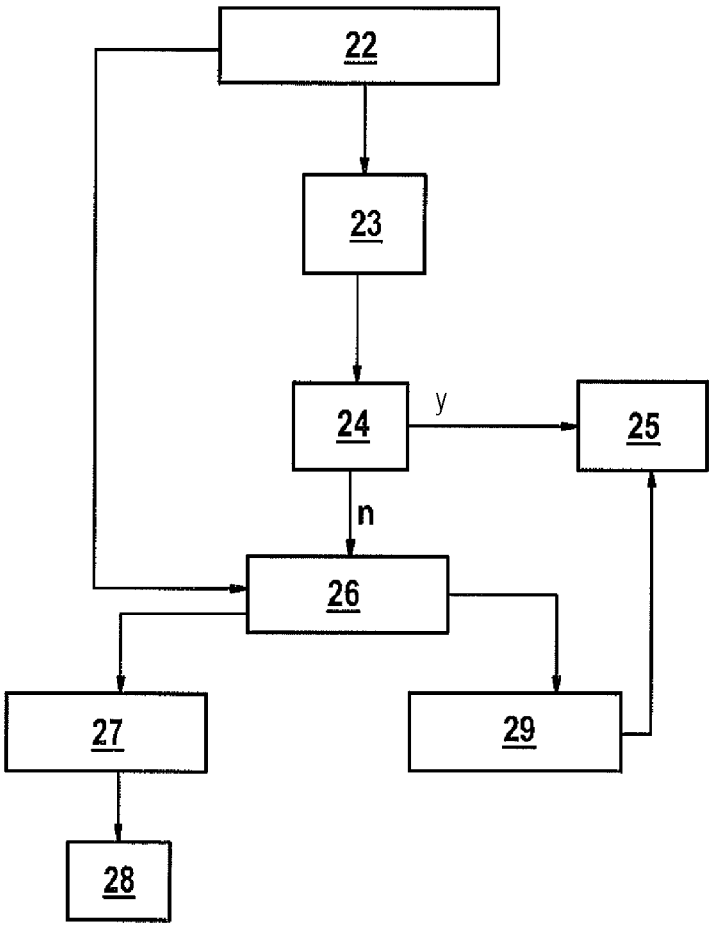

A method for operating the water-conducting domestic appliance 1 will now be explained with reference to FIG. 2. First in a step 22 a desired wash program is selected or preset by the user by way of the control panel 21. In a following step 23 a quantity of filling water is determined according to the selected program and supplied to the work chamber 4. In the following step 24 the motion of the control element of the water flow diverter 9 is checked by means of the facility 19 and the sensor 20. If it is ascertained in this process that the water flow diverter 9 or the control element of the water flow diverter 9 is stationary (y) and has therefore taken up the desired position for setting defined wash liquors, the method continues in a step 25, in which the true running check is performed to ascertain the true running of the circulating pump 15 or to check the minimum size of a quantity of filling water. A refilling step can also follow, in which the quantity of filling water is increased.

However if it is ascertained in step 24 that the control element of the water flow diverter 9 has not come to a stop but instead an error is present in the form of permanent motion (n), the method continues in a step 26. In step 26 it is decided in particular as a function of the selected wash operation that the true running test will be omitted and the water flow diverter will be deactivated or switched off. First in a step 27 the true running check is omitted. This ensures that if a malfunction of the water flow diverter 9 occurs, for example if permanent motion of the control element is detected, this does not cause too large a quantity of filling water to be supplied to the work chamber 4 or the domestic appliance 1, which could cause liquid to exit from the domestic appliance 1. Instead in a following step 28 a minimum quantity of filling water or a maximum quantity of filling water is preferably set, for example by brief filling, in other words through a valve opening for a certain time period. The minimum quantity of filling water ensures the true running of the circulating pump 15 with minimal water consumption. The maximum quantity of filling water ensures total cleaning of the items being washed and the true running of the circulating pump 15 and is limited so that the work chamber 4 is not overfilled.

Following step 26 in a step 29 the water flow diverter 9 is also deactivated. To this end the actuator driving the control element or the control element motor is disconnected from the power supply so that the control element comes to a stop. The actual motor current of the electric motor 16 alone is therefore a function of the quantity of filling water or the resulting true running or dry running of the circulating pump 15.

Finally provision can also be made, if the water flow diverter 9 is malfunctioning, to omit a refilling step for increasing the quantity of water as provided in the wash program for operating the water-conducting domestic appliance 1, to exclude overfilling of the water-conducting domestic appliance 1 and the exiting of water.

The method for operating the domestic appliance 1 therefore ensures the operational safety of the household appliance in a simple manner.

The invention claimed is:

1. A method for operating a water-conducting domestic appliance with a circulating pump and a water flow diverter which is associated with the circulating pump and has at least one control element configured for adjustment by a control element motor for changing a direction of flow of a liquid through the water flow diverter, and the water-conducting domestic appliance including a facility configured to control operation of the water-conducting domestic appliance, the method comprising:

filling the water-conducting domestic appliance with a minimum quantity of filling water to be circulated by the circulating pump;

determining whether the water flow diverter is malfunctioning with the facility by detecting a position of the at least one control element with at least one sensor;

performing a first true running check to check whether the minimum quantity of filling water corresponds at least a setpoint quantity of filling water required to ensure true running of the circulating pump;

evaluating for the first true running check at least one operational parameter of an electric motor driving the circulating pump to ascertain whether the circulating pump is running true; and if the facility determines that the water flow diverter is not malfunctioning, then performing a second true running check or a refilling step for increasing the minimum quantity of filling water.

2. The method of claim 1, wherein the water-conducting domestic appliance is a dishwasher.

3. The method of claim 1, wherein the water flow diverter is arranged downstream of the circulating pump.

4. The method of claim 1, wherein determining whether the water flow diverter is malfunctioning with the facility further comprise evaluating control signals that control the control element motor and sensor signals from the at least one sensor that detect the position of the control element of the water flow diverter.

5. The method of claim 4, wherein determining whether the water flow diverter is malfunctioning with the facility further comprises:

determining whether the sensor signals differ from the control signals and whether the sensor signals indicate that the at least one control element is stationary, determining whether the at least one sensor detects that the at least one control element is moving continuously without interruption, or determining whether the sensor signals from the at least one sensor deviate from an expected sensor signal profile or from an expected sensor signal sequence.

6. The method of claim 5, further comprising stopping the control element motor when a continuous and uninterrupted movement of the at least one control element of the water flow diverter is detected by the at least one sensor.

7. The method of claim 5, further comprising monitoring movement of the at least one control element with the at least one sensor by a contact-free measurement.

8. The method of claim 1, further comprising maintaining the minimum quantity of filling water fi the second true running check is not performed.

9. The method of claim 1, further comprising setting a minimum setpoint quantity of filling water or a maximum setpoint quantity of filling water the second true running check is not performed.

10. The method of claim 7, wherein the movement of the at least one control element is measured by the at least one sensor optically or electromagnetically, or both.

11. A water-conducting domestic appliance, comprising:

a circulating pump configured to circulate a minimum quantity of filling water filled in the water-conducting domestic appliance, an electric motor configured to drive the circulating pump, a water flow diverter associated with the circulating pump, at least one control element constructed to change a direction of flow of a liquid through the water flow diverter, a control element motor configured to adjust a position of the at least one control element, at least one sensor configured to detect the position of the at least one control element, and a facility configured to determine whether the water flow diverter is malfunctioning and to perform a first true running check of the circulating pump, wherein the facility is configured to determine whether the water-conducting domestic appliance has been filled to the minimum quantity of filling water that corresponds at least to a setpoint quantity of filling water required to ensure the true running of the circulating pump, wherein the facility is configured to evaluate at least one operational parameter of the electric motor driving the circulating pump to ascertain whether the at least one operational parameter corresponds to true running of the circulating pump, and wherein if the facility determines that the water flow diverter is not malfunctioning, the facility is configured to perform a second true running check or a refilling step for increasing the minimum quantity of filling water.

12. The water-conducting domestic appliance of claim 11, wherein the water-conducting domestic appliance is a dishwasher.

13. The water-conducting domestic appliance of claim 11, wherein the water flow diverter is arranged downstream of the circulating pump.

14. The water-conducting domestic appliance of claim 11, wherein the facility is configured to evaluate control signals for controlling the control element motor and sensor signals from the at least one sensor for detecting the position of the control element of the water flow diverter.

15. The water-conducting domestic appliance as claimed in claim 14, wherein the facility is configured to determine that the water flow diverter is malfunctioning:

the facility determines that the sensor signals differ from the control signals and whether the sensor signals indicate that the at least one control element is stationary, the facility determines that the at least one control element is moving continuously without interruption, or the facility determines that the sensor signals deviate from an expected sensor signal profile or from an expected sensor signal sequence.

16. The water-conducting domestic appliance of claim 15, wherein the facility is configured stop the control element motor when a continuous and uninterrupted movement of the at least one control element of the water flow diverter is detected by the at least one sensor.

17. The water-conducting domestic appliance of claim 11, wherein the minimum quantity of filling water is maintained if the second true running check is not performed.

18. The water-conducting domestic appliance of claim 11, wherein a minimum setpoint quantity of filling water or a maximum setpoint quantity of filling water is set if the second true running check is not performed.

19. The water-conducting domestic appliance of claim 11, wherein the at least one sensor is configured to monitor a movement of the control element by a contact-free measurement.

20. The water-conducting domestic appliance of claim 19, wherein the movement of the control element is measured by the at least one sensor optically or electromagnetically, or both.

* * * * *